United States Patent [19]

Ferrara

[11] Patent Number: 4,582,626

[45] Date of Patent: Apr. 15, 1986

[54] SOAP COMPOSITIONS AND PROCESS WITH EMOLLIENTS, BATH OILS AND POLYMERIC ETHYLENE OXIDE SLIP AGENTS

[76] Inventor: Peter J. Ferrara, Ridge Rd., P.O. Box 441, Cornwall, N.Y. 12518

[21] Appl. No.: 624,240

[22] Filed: Jun. 25, 1984

Related U.S. Application Data

[63] Continuation-in-part of Ser. No. 384,790, Jun. 4, 1982, abandoned.

[51] Int. Cl.[4] ..... C11D 9/26; C11D 9/48; C11D 13/10; C11D 13/18

[52] U.S. Cl. ..... 252/122; 252/126; 252/127; 252/132; 252/134; 252/174.21; 252/368; 252/369; 252/370; 252/DIG. 16

[58] Field of Search ..... 252/122, 126, 127, 132, 252/134, 174, 174.21, DIG. 16, 368, 369, 370

[56] References Cited

U.S. PATENT DOCUMENTS

| | | | |
|---|---|---|---|
| 3,814,698 | 6/1974 | Ferrara | 252/370 |
| 3,941,712 | 3/1976 | Ferrara | 252/126 |
| 4,148,743 | 4/1979 | Schubert | 252/132 |
| 4,169,066 | 9/1979 | Joshi | 252/132 |
| 4,169,067 | 9/1979 | Joshi | 252/132 |
| 4,198,311 | 4/1980 | France | 252/117 |
| 4,211,675 | 7/1980 | Machin | 252/557 |
| 4,231,904 | 11/1980 | Machin | 252/557 |
| 4,280,936 | 7/1981 | Dhabhar | 260/13 |
| 4,373,036 | 2/1983 | Chang | 523/120 |

*Primary Examiner*—Dennis L. Albrecht

[57] ABSTRACT

A hard, solid, milled cleaning material having improved slippery feel comprising a normally solid cleansing material and incorporated therein at least about 10% bath oil/emollient which was incorporated into a hot liquid precursor of said normally solid cleansing material and sufficient slip agent to improve the processability of said material and to improve the slippery feel thereof but insufficient to cause said material to be slimey, said proportion being about 0.2% to at least about 1% by weight.

7 Claims, No Drawings

SOAP COMPOSITIONS AND PROCESS WITH EMOLLIENTS, BATH OILS AND POLYMERIC ETHYLENE OXIDE SLIP AGENTS

CROSS-REFERENCE TO RELATED APPLICATIONS

This application is a continuation-in-part of U.S. Ser. No. 384,790, filed June 4, 1982, now abandoned.

This invention relates to solid soaps of the class referred to as milled soaps.

PRIOR ART

In FERRARA et al; U.S. Pat. Nos. 3,814,698 and 3,941,712, there are described novel techniques for producing milled soaps containing high levels of emollients and bath oil mixtures. The emollients and bath oils consist of mixtures containing at least one water immiscible product such as mineral oil or a water immiscible bath oil ester such as isopropyl myristate. The novel processes described therein differ from the usual methods of milled soap manufacture in that the bath oils and emollients, either singly or in combination are added and mixed into the hot liquid saponification mixture before it is cooled, solidified and dried rather than by milling these in. After drying, the soap chips or flakes are placed in an amalgamator where the soaps are mixed with suitable pigments, preservatives, and fragrances prior to milling and plodding. They are then extruded in the form of rods, bars or other shapes. A cutting machine reduces the extruded soap to pieces of lengths and weights to accommodate the dies used to mold and imprint the bars.

While the novel technology of the FERRARA et al patents make possible a wide latitude in the amounts and types of bath oils and emollients which can be incorporated in the soaps, these soaps must be pliable yet firm enough to withstand the mechanical handling as the soap passes through the succession of steps from milling and plodding, on through the final wrapping. If soap bars are too sticky or too soft, they must be handled at lower rates of processing with attendant disadvantage. Generally difficultly processable soaps can be run at acceptable speeds by a number of techniques well-known to those versed in the art.

Thus, incidence of softness or stickiness may be overcome by resorting to lubricants like brine solutions, water solutions of sodium lactate, glycerine, alcohols like ethanol and isopropanol. These lubricants or mould release agents are applied in various ways to the machinery parts coming in contact with the soap. The use of chilled dies, with the chilling produced by refrigerants passing through the internal cavity of a die is another way of offsetting soap stickiness. Refrigeration stiffens the soap surface areas by the rapid formation of a crystal lattice at the chilled surfaces. Non-stick materials, such as polytetrafluoro ethylene, polytrifluorochloro ethylene, silicone polymers and the like, may be coated on the dies to achieve the release effects. These steps are well-known to those versed in the art. Additionally, manufacturers can improve the surface stiffness of soaps by adjusting the amounts of salt, more particularly sodium chloride, added to the soap while it is still in the hot liquid phase.

Manufacturers of soap can also manipulate, within limits, the process of soap drying. Thus by producing a soap with a moisture level of 5–6%, as opposed to the usual 9–12% level, the soaps display an extra degree of firmness. This is a costly solution to the problem especially if the drying capacity available is inadequate to remove this extra water.

When producing milled soaps having large quantities of water immiscible bath oils and/or emollients incorporated therein for the purpose of providing an exceptionally fine feel with residual emollient effects, it has been found that the soap so produced is particularly difficult to work on a given production line at expected speeds. Even the known production speed up techniques set forth above do not seem to be capable of achieving adequate production rates where at least about 10 weight percent emollients or the like have been incorporated with the hot liquid saponification mixture prior to cooling, etc.

Thus, it is a principal object of this invention to provide a milled soap containing at least about 10 weight percent water immiscible emollients which is easily processed on conventional soap making machinery at good production speeds and substantially no adverse effects.

In the United States Patents of FERRARA et al, referred to above, the production of soaps with high levels of bath oils and emollients is given particular emphasis. One reason for this emphasis is the growing awareness among users of skin care products that certain water insoluble or immiscible emollients and bath oils do in fact help maintain healthy skin conditions. Claims for such soaps include words like "nurtures", "nourishes", "revitalizes" and even "eliminates wrinkles". These soaps are also characterized as "moisturizing". Another objective of this invention is to produce a soap having the capacity to offer such beneficial aspects. Referring to the art of the FERRARA et al patents, the soap products of those inventions have in fact demonstrated benefits to users thereof.

It is however, an object to provide such a desirable emollient soap product which is easily processible and has a perceptibly superior feel relative to lower, or non-emollient soaps.

There are certain generally recognized criteria associated with the perception that a soap is beneficial. For example, when the soap is used, it should leave the skin with a feeling of softness and appear as contributing to a lubricated effect in a pleasing manner. It must also be gentle, mild, and demonstrate desirable cleansing effects. It should lather well. With these targets in mind, researchers have generated a wide range of products and promises. Among these new ideas one finds soaps containing proteins derived from hydrolyzed collagen, and products with cationic properties. Molecules of both categories are supposed to give rise to substantivity, another style of defining lubricity. These special effects are not easily measured even with the aid of modern analytical devices such as scanning electro micrographs.

The true measure of skin benefits to be derived from an emollient soap can only be established through continued use, over a period of time; a week, a month, and even longer in some cases. Soaps with oils and emollients made by the art of FERRARA et al give rise to a lower incidence of chapped hands during winter when cold and low humidity are generally experienced. The increase in substantivity may also be shown through a longer period of fragrance retention as opposed to the usual soaps. These attributes are subjective, interpreted by each subject user in his or her own way. To break through the challenge of perception, this invention has another objective; which is to make a product which is instantly perceived to be "different", that is different in a beneficial way.

BRIEF STATEMENT OF THE INVENTION

In accord with and fulfilling these objects, one significant aspect of this invention is to further enhance high emollient content milled soaps by incorporating therein at least one additive in sufficient quantity and form to increase the slipperiness of the soap bar in order to improve its processibility as well as its user perceived feel. This is accomplished by incorporating one or more slip agents into the milled soap, preferrably incorporating such agent into the saponification mixture along with the water immiscible emollients as set forth in the above cited FERRARA et al patents.

It is important to note that the slip agents are preadmixed with the bath oil emollient before incorporating such into the saponification mixture and that the slip agents and the emollient are substantially unreactive with respect to each other. One way of determining this unreactivity is to mix the bath oil and the slip agent together, preferably at ambient temperature conditions, and observe that the viscosity of this mixture does not appreciably change, e.g., increase, with time. Particularly, the viscosity of this mixture does not substantially change over a period of at least about one hour.

One particular aspect of this invention is the bath oil-slip agent physical mixture itself which has advantageous and unexpected utility according to this invention in being able to incorporate slip agent ethylene oxide polymers into soap compositions without forming the disadvantageous stringers which existed when these polymers were incorporated without admixture with non-reactive bath oil. In a further preferred embodiment of this invention, the slip agent ethylene oxide polymers are preferably maintained in a substantially dry condition until admixture within the bath oil emollient. Thereafter contact with water, for example in the saponification bath, is permitted.

DETAILED DESCRIPTION OF THE INVENTION

Slip agents are known class of materials which may be water soluble or insoluble. Exemplary of such materials are poly alkylene oxides—e.g., ethylene oxide and/or propylene oxide homo and/or copolymers having molecular weights of about 100,000 to more than 5,000,000. Such materials have been used in cleansing compositions in the past since they are non-ionic surfactants and therefore capable of assisting in dirt solubilization and floatation. See for example, U.S. Pat. No. 3,248,333, O'Roark wherein Polyox WSR-205-an ethylene oxidepolyether having a molecular weight of about 600,000—was incorporated in a soap in a proportion of about 0.3125%. Note, however, that the composition of this patent is a synthetic detergent and not a soap and that this polyether was added to the composition in the amalgamator, not into the liquid saponification mixture as required by the instant invention for reasons which will become readily apparent from the examples and further discussion below.

Other known slip agents include vinyl polymers having carboxyl side groups which are sometimes known in the trade as Carbopol resins. Such slip agents and many other similarly equivalent materials are widely known and do not per se constitute this invention. Nor does the pure incorporation of slip agents in cleansing bars constitute this invention.

This invention does, however, constitute in part solid cleansing compositions, soaps or syndets, which have incorporated therein a high proportion of bath oil and/or emollient and a slip agent both having been incorporated into a hot liquid precursor of the solid product well prior to solidification, amalgamation milling, plodding and extruding. In the case of soaps, this addition is to the hot, liquid saponification mixture. Thus, to reiterate, there are at least two aspects of this invention: the cleansing product preferably soap containing both high proportions of water immiscible bath oil/emollients and sufficient slip agent to give an immediate added slippery feel to the milled bar thereof; and the method of incorporating such slip agent into the solid milled cleansing product along with the bath oil/emollients and sufficient slip agent to give an immediate added slippery feel to the milled bar thereof; and the method of incorporating such slip agent into the solid milled cleansing product along with the bath oil/emollient into a hot liquid precursor of the solid product prior to amalgamation, etc.

The following examples will demonstrate certain facets of this invention.

EXAMPLE 1

In this Example 1, we took a quantity of soap chips made according to the FERRARA et al technology. These chips contained 10.7% moisture and approximately 12% added emollient, calculated on the soap solids, which had been added at the stage where it was still hot (88° C.–90° C.) and liquid. The emollient was a mixture of mineral oil, glyceryl monostearate, a coconut-oil fatty acid ester of sodium isethionate, and a coco-betaine. The soap chips were fed to an amalgamator, and there was added 0.40% ethylene oxide polyether of about 5,000,000 molecular weight, 0.20% titanium dioxide, and 1.25% fragrance. After thorough mixing, the soap was conventionally processed through a plodder equipped at the outlet with a fine screen. The fine "spaghetti" soap product was then milled 3 times until the flakes showed uniform dispersion of the $TiO_2$ pigment. At this point the flakes were transferred to a plodder-extruder unit, and formed in the bars which in cross section measured 1"×2". The soap bar was cut into 4" lengths and fed into a press.

On aging overnight at room temperature, the soap bars were tested for residual feel and slipperiness. It was then apparent that the bars thus made were not only slippery but were quite slimey. In fact the slime formation was sufficient to cause the development of soap strings or strands as the hands are parted; one hand holding the soap as the other hand was withdrawn. The soap stands were strong enough to be stretched as much as 2–3 inches before breaking apart. Even continued use of the bar, to simulate a "wearing-down" of the bar, did not materially effect a change in the development of the soap strands. The "strands" were not unlike one experiences with stretching candy like "taffy", or from trying to pull apart hot toasted marshmallows. While these effects were quite extraordinary, and certain to create the perception of a different soap, the end result was considered too messy to be of practical value.

An interesting observation derived from this experiment is that the bars showed practically no tendency to be sticky when being shaped in the dies. The bars were easily separated from the stainless steel dies, and were sufficiently firm to take a sharp imprint. This experiment produced evidence that although these bars processed well, the product was not acceptable because it was too slimey and produced soap residue stringers.

EXAMPLE 2

In this example, we took 12 bars of the product of EXAMPLE 1, and placed these on edge on a circular tray, inside a 5 quart stainless steel pressure cooker. The soap tray was supported about 1½" from the bottom of the cooker. The bottom was covered with about ¾" of water. The cooker was brought to steam pressure of 15 pounds per square inch and held at this pressure for 45 minutes. After this interval, the cooker was de-pressurized and opened. The 12 bars of soap had darkened slightly from exposure to the steam. They were soft enough to yield a gel-like layer where the soaps contacted the supporting tray. When the soaps were cooled to room temperature, these were separated from the tray with a spatula, and re-pressed to the same shape as when installed in the cooker.

When the pressure cooked soap bars constituting this example were tested, it was found that the soaps no longer developed the stringiness evidenced in Example 1. There was no slimey feel, only a nice silky or soft feel which is characteristic of substantivity. The result of this example suggests that these soap bars in whatever form caused by the steam, were now quite good items.

The soaps of Example 2 were not sticky and separating cleanly from the stainless surfaces of the die and die frame.

EXAMPLE 3

In this Example the same ingredients in the same proportions were used as in Example 1 except that the ethylene oxide polyether was "dissolved" in mineral oil and added to a hot saponification mixture of the soap being used.

The soaps of Example 3 show the suitability of premixing the slip agent in a water immiscible oil like mineral oil prior to its being added to the hot liquid soap. The soap products produced as this Example 3 have a noticeable degree of slip-feel, lather extremely well, yield a soft, lubricated feel superior to that of soaps made without slip agent. The soaps are hard with a nice shiney finish. One of the surprising benefits from incorporating the slip agent by this technique is the absence of stickiness.

A large batch, made on a plant scale, approximately 2000 lbs. of soap solids, passed through chill rolls and soap dryer with comparative ease. Viscosity changed very little with the introduction of the slip agent in the manner described herein.

EXAMPLE 4

Having shown by way of Example 3, a method by which slip agent could be uniformly distributed within a soap by adding it as a dispersion in mineral oil, there remained the possibility of adding a portion of the slip agent by this route, and some by milling. This possibility might, if successful, provide a method of fine tuning the use of slip agents at higher levels. With this objective in mind, it was decided to include 0.27% of the same ethyleneoxide polyether in the same manner as Example 3, in the hot oil liquid soap, and when the soap chips produced by chilling and drying were obtained, to mill in an additional 0.13% of this same polyether following the milling steps of Example 1.

The product of this Example proved to be slimey and stringy very similar to the product produced in Example 1. Thus it can be concluded that not only is the incorporation of slip agent through milling not effective to produce the desired effects, but that it is actually detrimental and at least in these proportions overrode the beneficial effects produced by incorporating slip agent into the hot liquid precurser.

EXAMPLE 5

The literature on the slip agents exemplified above suggests that ethylene oxide polymers, being polyethers, hydrogen bond strongly with water. This fact accounts for their unusual thickening power which increase as the molecular weights increase to 5,000,000. This hydrogen bonding property also accounts for the formation of strong association complexes between this resin and highly polyunsaturated oils like a refined corn oil. With this thought in mind, we explored the addition of polyether to a hot liquid saponification mixture using corn oil as the dispersing agent.

When dispersions were made, adding the same polyether as in Example 1 to corn oil at a level of 0.80% based on soap solids, the mixtures showed a tendency to thicken with time. The thickening stopped after approximately 18 hours at which time, it was evident the polyether was in solution. This indicated the formation of a new association compound of corn oil with the polyethylene oxide.

When the polyether was introduced to the hot liquid saponification mixture using corn oil as a carrier, the end product, was not equal to Example 3 in lather and residual feel, even though the proportions of corn oil and polyether were maintained at the same level. On the other hand, the tendency for the bars to show any sticky quality was even less than Example 3.

Thus it appears that a different soap product has been created having superior slip but lower lather and residual oil feel.

The 5 examples set forth herein clearly establish the unique slip-agent effect of polyalkylene oxide polyether resins, when incorporated in a hot liquid soap with emollients and bath oils. The slippery characteristic is an easily perceived property. Less readily apparent, though of singular importance is the lubricating feel, and skin softening effect which is enhanced by incorporating such polyether slip agents. And, of particular significance to a producer of commercial soaps made in todays' modern, high speed processing equipment, the soaps so formulated have substantially eliminated any sticky aspects created with soaps having very high levels of oils and emollients.

In the manufacture of soaps using tallows, coconut oil and similar sources of fatty acids, the proportions of tallow and coconut oil (there are the principal sources of todays' commercial fatty acids) can be varied over a wide range, without compromising the benefits attributed to the soaps of this invention in their most preferred form.

While the maximum and minimum levels of slip agent may vary widely the investigations thus far suggest a minimum of about 0.20%; and a maximum tolerance of 1.0%. There is nothing to suggest usage of higher than 0.80% or 1.0% can deliver properties superior to those shown herein for 0.40%. However, this invention is in no way limited to such proportions, they being merely preferred.

U.S. Pat. Nos. 3,814,698 and 3,941,712 are hereby incorporated in their entirety by reference.

What is claimed is:

1. In the process of producing a hard, solid, milled cleansing material comprising soap which comprises forming a hot aqueous saponification mixture comprising saponified fatty acids, water, a saponifying agent, and at least about 10 weight percent bath oil emollient, based on said soap; ; cooling, solidifying and amalgamating said mixture; milling said solid comprising soap; and forming such into a solid, shaped cleansing product; the improvement, whereby permitting said process to be practiced more rapidly to produce said shaped product having improved slippery feel, which comprises admixing said bath oil emollient, prior to addition thereof to said hot aqueous saponification mixture, with up to about 10 weight percent, based on said oil, of an ethylene oxide polymeric slip agent, wherein said polymeric slip agent is present in an amount sufficient to permit said forming process to be run at high speed and then adding said admixture to said saponification mixture.

2. The process claimed in claim 1 wherein said ethylene oxide polymer is a homopolymer of about 500,000 to 5,000,000 molecular weight; said bath oil is at least one of mineral oils or esters; the proportion of ethylene oxide polymer to soap solids is about 0.2 to 1 weight percent; and the proportion of bath oil to soap solids is at least about 10 weight percent.

3. The cleansing product of the process of claim 1.

4. A hard, solid, milled cleansing material as claimed in claim 3 wherein said emollient oil is at least one member selected from the group consisting of mineral oils and esters which are substantially unreactive with ethylene oxide polymers.

5. A cleansing material as claimed in claim 3 in bar form.

6. A cleansing material as claimed in claim 3 wherein said slip agent comprises a polyalkylene oxide polyether of molecular weight of about 500,000 to 5,000,000.

7. A hot liquid aqueous saponification mixture comprising at least one saponified fatty acid, water, a saponifying agent and a preformed substantially unreacted mixture of at least about 10 weight percent, based on the weight of soap product recovered from said saponification mixture, of a substantially water immiscible emollient oil and up to about 10 weight percent, based on the weight of said oil, of a polymeric slip agent comprising ethylene oxide; said saponification mixture being adapted to be processed into hard, substantially nonsticky cleansing bars comprising soap of shiney finish at high processing speeds.

* * * * *